US009434187B2

(12) United States Patent
Mashima et al.

(10) Patent No.: US 9,434,187 B2
(45) Date of Patent: Sep. 6, 2016

(54) RECORDING APPARATUS

(71) Applicant: SEIKO EPSON CORPORATION, Tokyo (JP)

(72) Inventors: Akira Mashima, Azumino (JP); Nobuhiko Hamada, Shiojiri (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 14/738,356

(22) Filed: Jun. 12, 2015

(65) Prior Publication Data

US 2015/0367658 A1 Dec. 24, 2015

(30) Foreign Application Priority Data

Jun. 18, 2014 (JP) ..... 2014-125088

(51) Int. Cl.
*B41J 11/20* (2006.01)
*B41J 3/407* (2006.01)
*B41J 11/06* (2006.01)

(52) U.S. Cl.
CPC ..... *B41J 11/20* (2013.01); *B41J 3/4078* (2013.01); *B41J 11/06* (2013.01)

(58) Field of Classification Search
CPC ..... B41J 11/20
USPC ..... 347/104
See application file for complete search history.

(56) References Cited

U.S. PATENT DOCUMENTS

| | | | | |
|---|---|---|---|---|
| 4,023,662 | A * | 5/1977 | Perucca | B41J 25/308 346/139 A |
| 5,854,643 | A * | 12/1998 | Katsuyama | B41J 3/4078 271/7 |
| 7,040,748 | B2 | 5/2006 | Niimi et al. | |
| 2010/0201743 | A1* | 8/2010 | Miyata | B41J 25/3088 347/37 |
| 2010/0245414 | A1* | 9/2010 | Burroughs | B41J 25/3088 347/8 |
| 2013/0140131 | A1* | 6/2013 | Kaminski, Jr. | B65G 39/02 193/37 |
| 2013/0314483 | A1 | 11/2013 | Moriya et al. | |
| 2014/0028746 | A1 | 1/2014 | Chen | |

FOREIGN PATENT DOCUMENTS

| | | |
|---|---|---|
| JP | 2004-291399 | 10/2004 |
| JP | 2013-244615 | 12/2013 |
| WO | 2007/097588 | 8/2007 |

OTHER PUBLICATIONS

European Search Report for Application No. 15172766.6 dated Nov. 16, 2015.

* cited by examiner

*Primary Examiner* — Stephen Meier
*Assistant Examiner* — Alexander D Shenderov
(74) *Attorney, Agent, or Firm* — Workman Nydegger

(57) ABSTRACT

A recording apparatus includes a support unit that is capable of supporting a target recording medium, a recording unit that is capable of recording on a target recording medium that is supported by the support unit, and a plurality of adjustment units that adjust an interval between the support unit and the recording unit.

8 Claims, 14 Drawing Sheets

RECORDING APPARATUS

BACKGROUND

1. Technical Field

The present invention relates to a recording apparatus.

2. Related Art

In the related art, a recording apparatus, which is provided with a tray that is capable of supporting a target recording medium, and a recording unit that is capable of recording on a target recording medium that is supported by the tray, and which is capable of adjusting an interval (a so-called PG, referred to as a Platen gap, a Paper gap, a Print gap or the like) between the tray and the recording unit is used.

For example, JP-A-2004-291399 discloses a recording apparatus, which is provided with a platen (a support unit) that is capable of supporting a target recording medium, and an ink jet head (a recording unit), and which is capable of adjusting the PG using a height adjustment mechanism that has a lever.

In addition, in recent years, recording on various target recording media with differing thicknesses has been required.

However, recording apparatuses of the related art such as that disclosed in JP-A-2004-291399, which are capable of adjusting the PG, only have a single PG adjustment unit. Further, in order to adjust the PG to correspond to various target recording media with differing thicknesses with high precision using a single adjustment unit, it is necessary increase the size of an adjustment range, and therefore, this results in an increase in the size of the adjustment unit.

SUMMARY

An advantage of some aspects of the invention is to achieve both a reduction in the size of an adjustment unit, and adjustment with high precision in a recording apparatus that is provided with an adjustment unit that is capable of adjusting an interval between a support unit that is capable of supporting a target recording medium, and a recording unit.

According to a first aspect of the invention, there is provided a recording apparatus including a support unit that is capable of supporting a target recording medium, a recording unit that is capable of recording on a target recording medium that is supported by the support unit, a first adjustment unit that adjusts an interval between the support unit and the recording unit, and a second adjustment unit that adjusts an interval between the support unit and the recording unit.

In the recording apparatus of a second aspect of the invention, according to the first aspect, an adjustment range of the first adjustment unit and an adjustment range of the second adjustment unit may differ.

In the recording apparatus of a third aspect of the invention, according to the first aspect or the second aspect, the first adjustment unit and the second adjustment unit may be provided in different positions when viewed from an adjustment direction of the interval.

In the recording apparatus of a fourth aspect of the invention, according to any one of the first aspect to the third aspect, in the support unit, it may be possible to set the target recording medium from a setting direction that intersects an adjustment direction of the interval, and at least one of the first adjustment unit and the second adjustment unit may be an adjustment lever that has a moveable range on a downstream side in the setting direction.

In the recording apparatus of a fifth aspect of the invention, according to any one of the first aspect to the fourth aspect, a base unit, a first connection section, which connects the base unit and the support unit, and which is provided with at least one of the first adjustment unit and the second adjustment unit, and a second connection section that connects the base unit and the support unit, may be further provided.

In the recording apparatus of a sixth aspect of the invention, according to the fifth aspect, the second connection section may be provided in a position that is closer to the center of gravity of the support unit than the first connection section.

In the recording apparatus of a seventh aspect of the invention, according to the sixth aspect, in the support unit, it may be possible to set the target recording medium from a setting direction that intersects an adjustment direction of the interval, and the second connection section may be provided further on an upstream side in the setting direction than the first connection section, and may have a concave section that is indented on a downstream side in the setting direction.

In the recording apparatus of an eighth aspect of the invention, according to the first aspect or the second aspect, the first adjustment unit and the second adjustment unit may be provided in positions that overlap in the adjustment direction of the interval.

In the recording apparatus of a ninth aspect of the invention, according to the eighth aspect, the first adjustment unit and the second adjustment unit may be adjustment levers that have rotational axes in the adjustment direction of the interval, and a corotation suppression mechanism that suppresses the rotational movement of a non-target adjustment lever that follows the rotational movement of a target adjustment lever, may be provided.

In the recording apparatus of a tenth aspect of the invention, according to the ninth aspect, the corotation suppression mechanism may be provided between a target adjustment lever and a non-target adjustment lever, and may have a structure that suppresses rotational movement that follows the rotational movements of a target adjustment lever and a non-target adjustment lever.

EFFECTS OF THE INVENTION

According to the invention, it is possible to achieve both a reduction in the size of an adjustment unit, and adjustment with high precision in a recording apparatus that is provided with an adjustment unit that adjusts an interval between a support unit that is capable of supporting a target recording medium, and a recording unit.

BRIEF DESCRIPTION OF THE DRAWINGS

The invention will be described with reference to the accompanying drawings, wherein like numbers reference like elements.

DESCRIPTION OF EXEMPLARY EMBODIMENTS

Embodiment 1

FIGS. 1 to 8

Hereinafter, a recording apparatus according to embodiment 1 of the invention will be described in detail with reference to the appended drawings.

Figure 1:
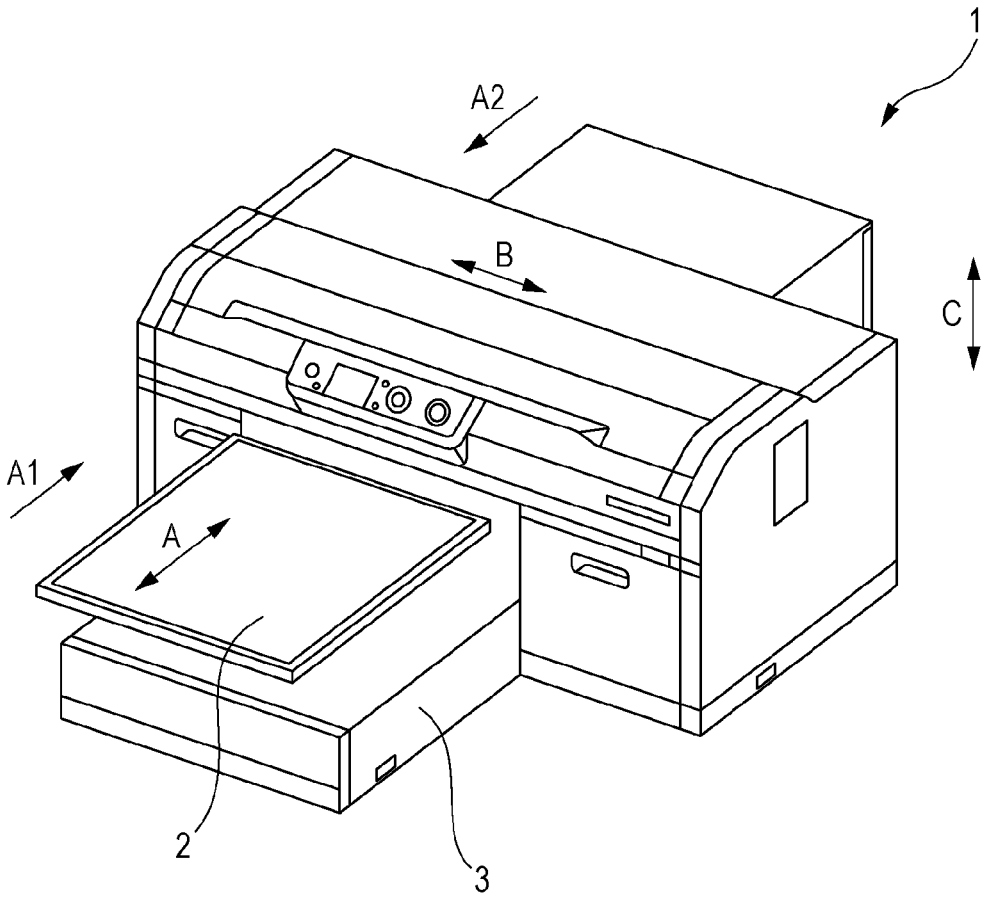
FIG. 1 is a schematic perspective view that represents a recording apparatus according to embodiment 1 of the invention.
Figure 2:
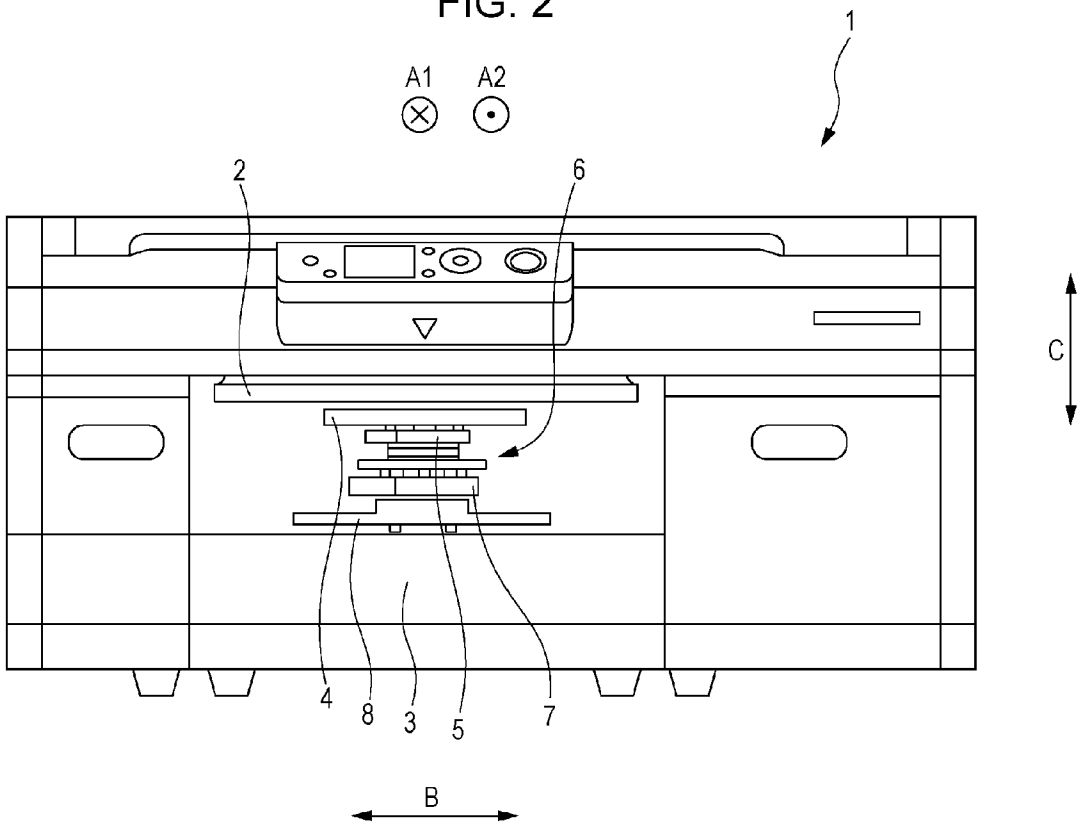
FIG. 2 is a schematic front view that represents the recording apparatus according to embodiment 1 of the invention.
Figure 3:
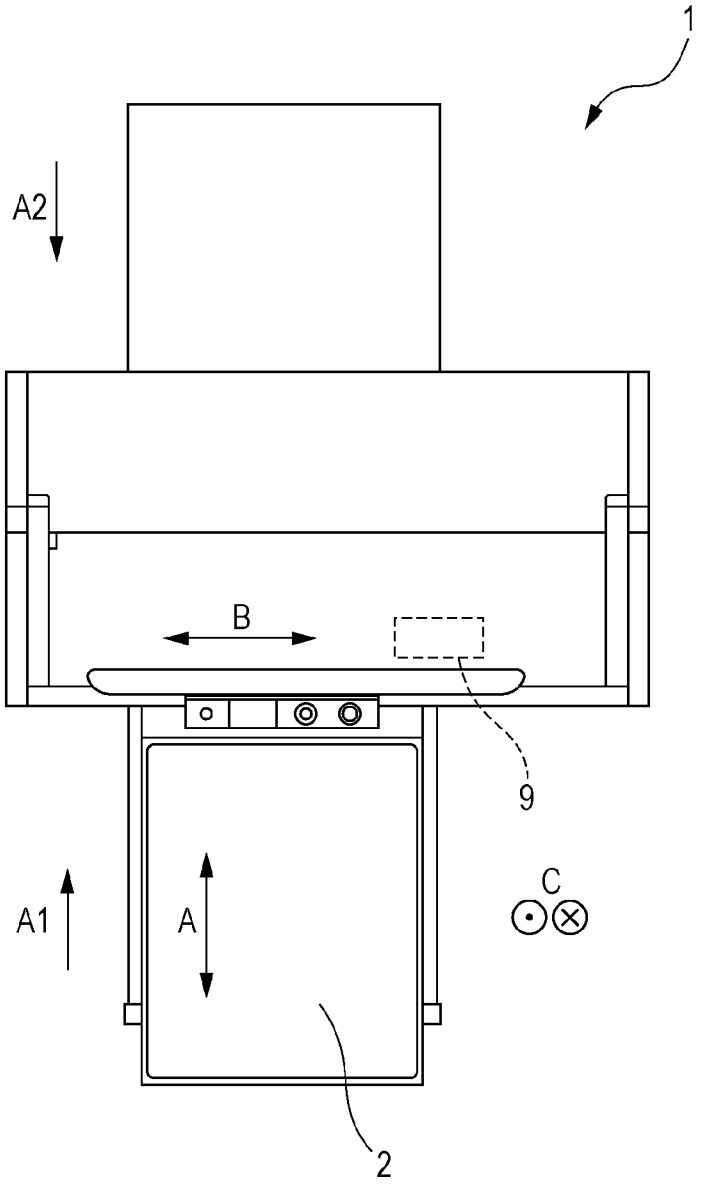
FIG. 3 is a schematic plan view that represents the recording apparatus according to embodiment 1 of the invention.
Figure 4:
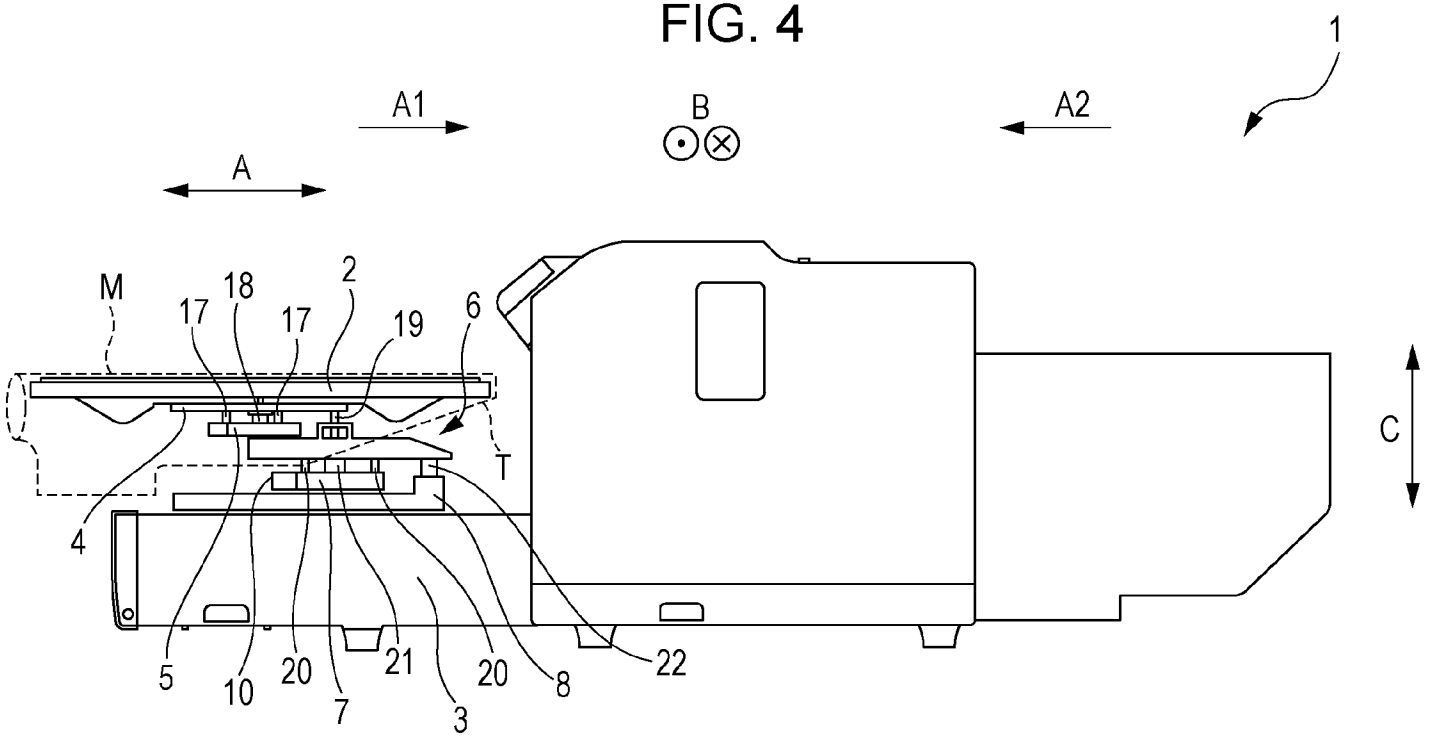
FIG. 4 is a schematic lateral view that represents the recording apparatus according to embodiment 1 of the invention.

FIG. 1 is a schematic perspective view of a recording apparatus 1 of the present embodiment, FIG. 2 is a schematic front view, FIG. 3 is a schematic plan view, FIG. 4 is a schematic lateral view, and all of FIGS. 1 to 4 represent states in which a tray 2, which is capable of supporting a target recording medium M, is in a setting position in which the target recording medium M is set.

The recording apparatus 1 of the present embodiment is provided with a support unit that is capable of supporting the target recording medium M. More specifically, the recording apparatus 1 is provided with the tray 2 as an example of a support unit. Additionally, as long as the support unit is a support unit that has a support surface that is capable of supporting the target recording medium M, the support unit may be any kind of support unit. As is represented by FIG. 4, in a case in which, for example, a T-shirt is used as the target recording medium M, in a state in which the tray 2 is in the setting position, a user puts the T-shirt on the tray 2 in a setting direction A1 from a hem T side of the T-shirt, and sets the T-shirt so that a portion of the T-shirt on which recording is desired is positioned on an upper surface of the tray 2. That is, the recording apparatus 1 of the present embodiment has a configuration in which it is possible to set the target recording medium M in a setting direction A1.

Additionally, the recording apparatus 1 of the present embodiment has "a configuration in which it is possible to set the target recording medium M in a setting direction A1", but for example, it may be possible to set a target recording medium M, which has an insertion section, such as the hem T of a T-shirt and a hand insertion section of gloves, from at least one direction. In addition, if it is possible to set a target recording medium M in this manner, it may be possible to mount a target recording medium M in the manner of the recording apparatus 1 of the present embodiment. In addition, a recording medium that is used as the target recording medium M may not have insertion sections. For example, objects that have a thickness that would be difficult to interpose between roller or the like (electronic component, mechanical component of the like) may be used as the target recording medium M by being mounted on the tray 2. In addition, objects that have are very thin such as paper and labels may be set as the target recording medium M.

In addition, as represented by FIGS. 1 to 4, the recording apparatus 1 of the present embodiment is provided with a transport unit 3, which is a transport mechanism of the tray 2, and it is possible to transport the target recording medium M that is supported by the tray 2 in a transport direction A (the setting direction A1 and a direction A2 that is opposite to the setting direction A1). Additionally, when recording is performed on a target recording medium M that is set in the setting position, the tray 2, on which the target recording medium M is set, is moved once in the setting direction A1 to a recording initiation position, and thereafter, recording is performed while moving the tray 2, on which the target recording medium M is set, from the recording initiation position in the direction A2.

In addition, as represented by FIG. 3, a recording head 9 is provided inside a main body of the recording apparatus 1, as a recording unit. Further, the recording apparatus 1 of the present embodiment forms a desired image by discharging ink onto the target recording medium M, which is supported and transported by the tray 2, from the recording head 9 while causing the recording head 9 to reciprocate in a direction B that intersects the transport direction A of the target recording medium M.

In addition, as represented by FIG. 2 and FIG. 4, the recording apparatus 1 of the present embodiment is provided with a stage 4 on which the tray 2 is mounted. At this time, the tray 2 is capable of being detached from the stage 4. In addition, the recording apparatus 1 of the present embodiment is provided with a base unit 8 that receives a driving power from the transport unit 3 when the target recording medium M is transported in the transport direction A, and a connection mechanism 6 that connects the stage 4, on which the tray 2 is mounted, and the base unit 8. Further, an adjustment lever 5 and an adjustment lever 7, which are capable of moving the stage 4, on which the tray 2 is mounted, in a direction C, which is a direction that intersects both the transport direction A and the direction B, with respect to the base unit 8, is provided in the connection mechanism 6.

Additionally, in the recording apparatus 1 of the present embodiment, the tray 2 has a configuration of being mounted on the stage 4, but, for example, may have a configuration in which a tray that supports the target recording medium M, and a base unit are connected by a direct connection mechanism in the manner of a configuration in which the tray 2 and the stage 4 are integrated.

Next, the main parts of the recording apparatus 1 of the present embodiment will be described.

Figure 5A:
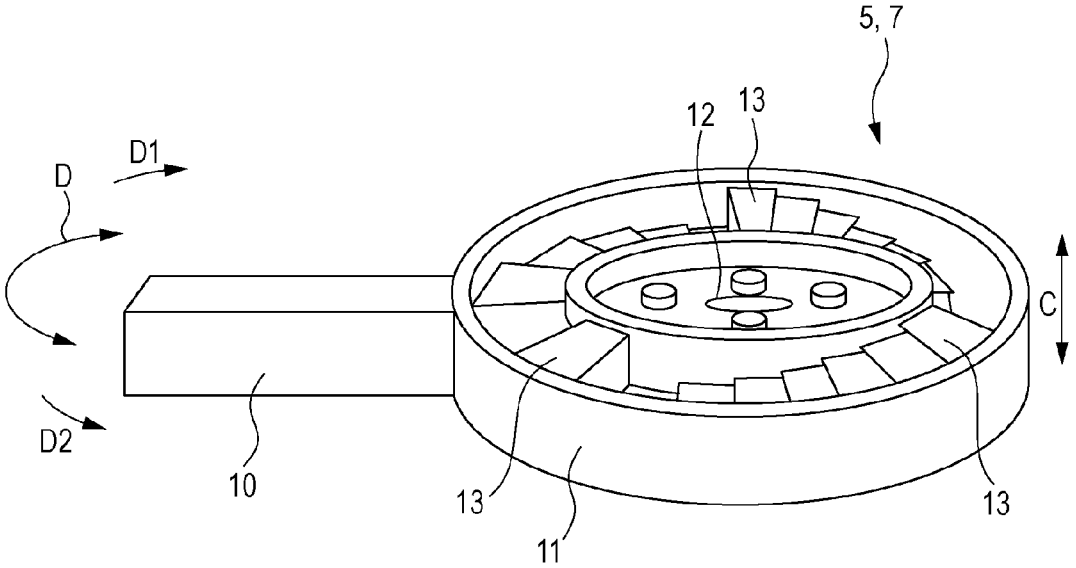
FIGS. 5A and 5B are schematic perspective views that represent the main parts of the recording apparatus according to embodiment 1 of the invention.
Figure 5B:
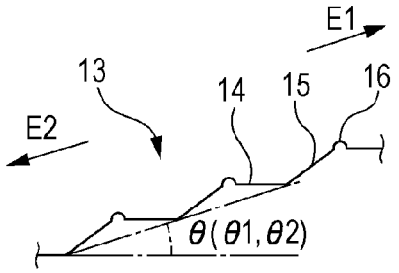

FIGS. 5A and 5B are schematic perspective views that represent the adjustment lever 5, which is a main part of the recording apparatus 1 according to the present embodiment and the adjustment lever 7 has the same configuration.

In this instance, the adjustment lever 5 and the adjustment lever 7 are both adjustment units that adjust an interval (a so-called PG, referred to as a Platen gap, a Paper gap, a Print gap or the like) between the tray 2 and the recording head 9. In other words, the recording apparatus 1 is provided with at least a first adjustment unit and a second adjustment unit. At this time, the adjustment lever 5 corresponds to the first adjustment unit, and the adjustment lever 7 corresponds to the second adjustment unit. However, this correspondence relationship may be the reverse of this. In this manner, by providing a plurality of adjustment units, increases in the size of each adjustment unit is suppressed. Additionally, the adjustment units can displace an interval between the tray 2 and the recording head 9 along the direction C. Therefore, the direction C corresponds to an adjustment direction of the interval between the tray 2 and the recording head 9.

In addition, the PG adjustment ranges of the adjustment lever 5 and the adjustment lever 7 are different, the adjustment range of the adjustment lever 5 is for small minute adjustments, and the adjustment range of the adjustment lever 7 is for large coarse adjustments.

In other words, the adjustment range of the first adjustment unit and the adjustment range of the second adjustment unit are different. As a result of this kind of configuration, in a case in which recording is performed on a T-shirt or the like, for example, which is thin, as the target recording medium M, it is possible to perform adjustment using the adjustment lever 5 only, and in a case in which recording is performed on a target recording medium M that is thick, it is possible to perform minute adjustments with the adjustment lever 5 after performing coarse adjustments with the adjustment lever 7. Therefore, it is possible to adjust the PG with respect to various thicknesses of target recording medium M with high precision.

Figure 6:
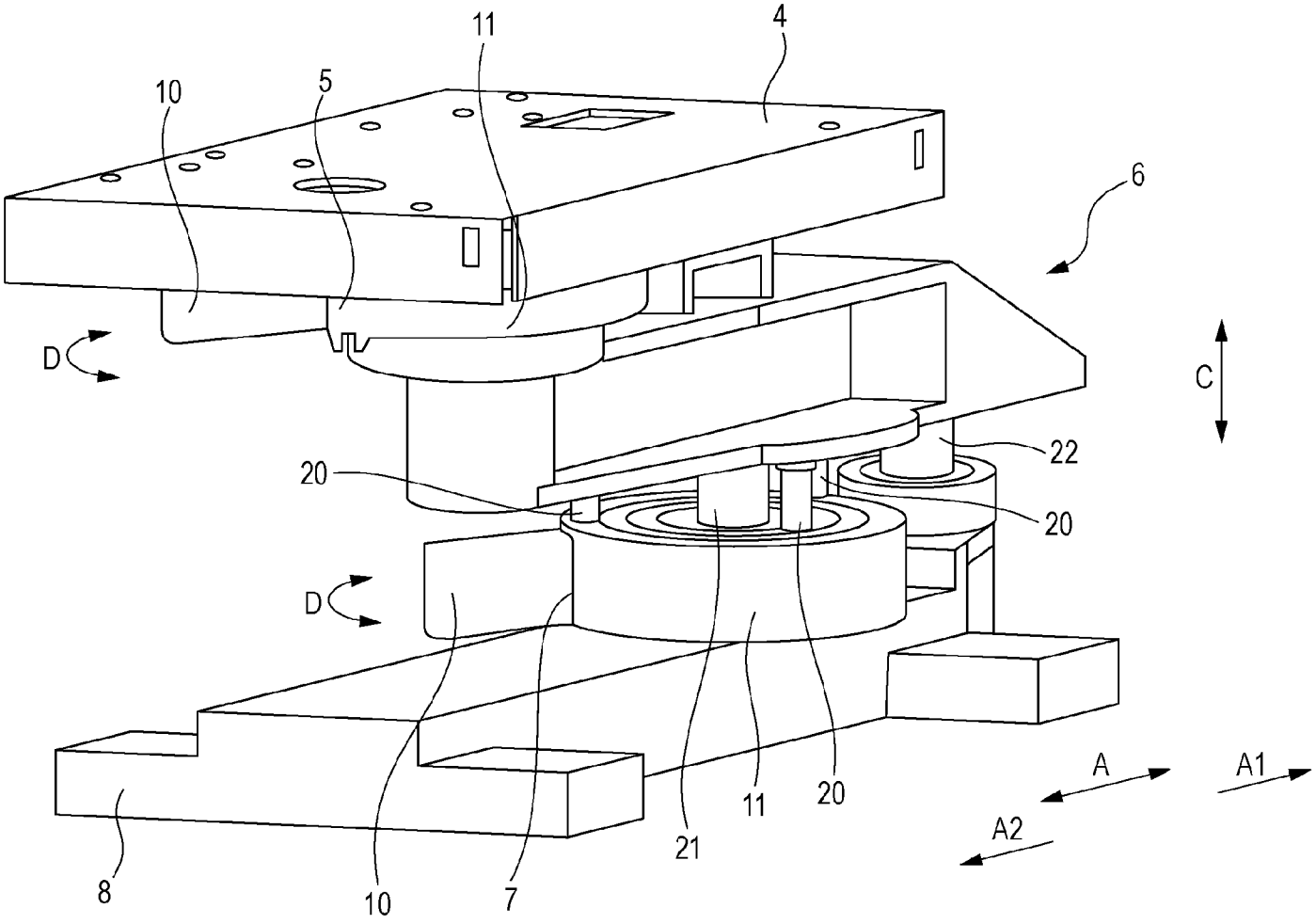
FIG. 6 is a schematic perspective view that represents the main parts of the recording apparatus according to embodiment 1 of the invention.
Figure 7:
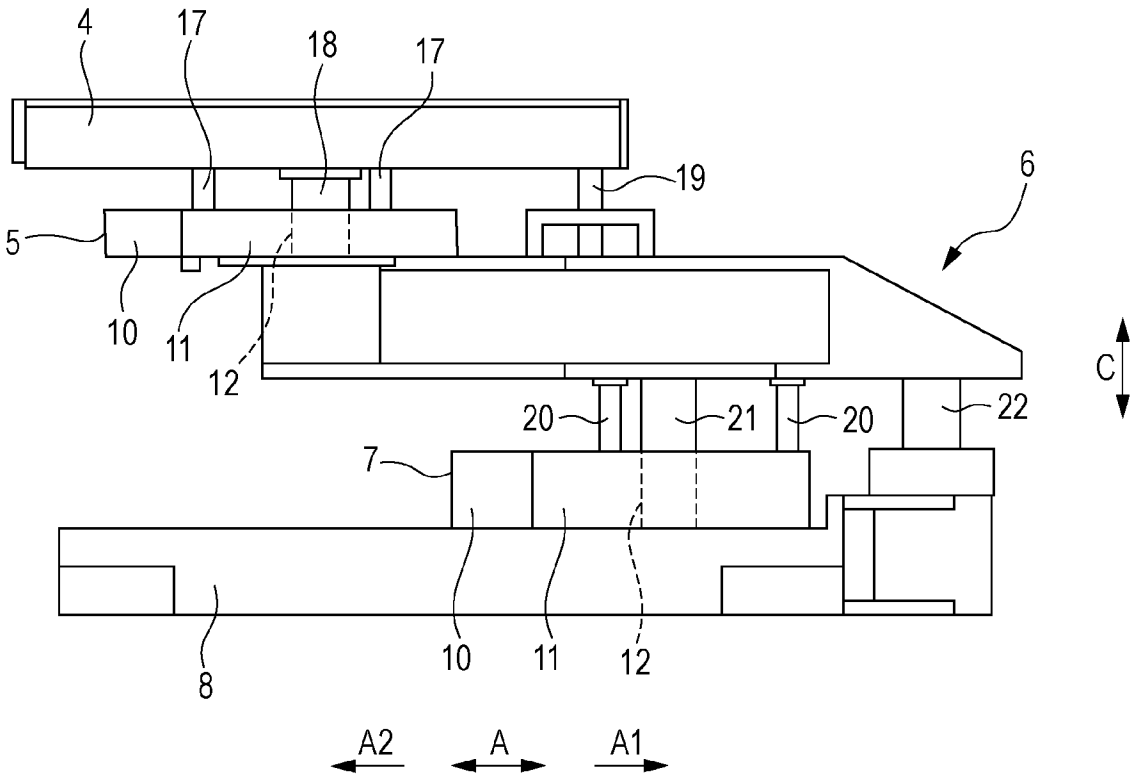
FIG. 7 is a schematic lateral view that represents the main parts of the recording apparatus according to embodiment 1 of the invention.
Figure 8:
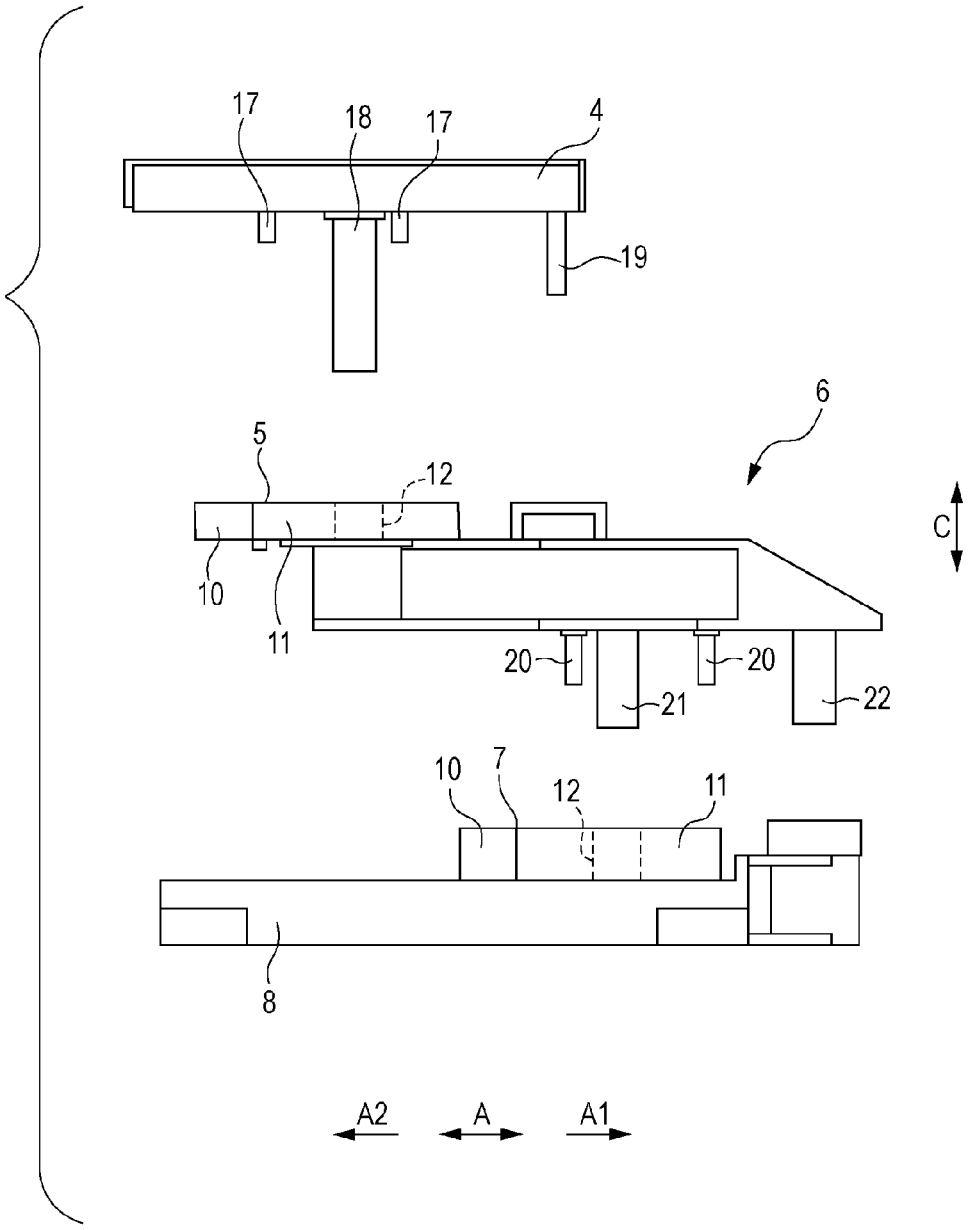
FIG. 8 is a schematic exploded lateral view that represents the main parts of the recording apparatus according to embodiment 1 of the invention.

In addition, FIG. 6 is a schematic perspective view that represents the stage 4, on which the tray 2 is mounted, the connection mechanism 6, and the base unit 8, which are the main parts of the recording apparatus 1 of the present embodiment, FIG. 7 is a schematic lateral view thereof, and FIG. 8 is a schematic exploded lateral view thereof.

As represented by FIG. 5A, the adjustment lever 5 has a main section 11, and a handle section 10, and a user can move the stage 4 in the direction C with respect to the connection mechanism 6 (in directions that approach and separate from the connection mechanism 6) by holding the handle section, and performing rotational movement of the adjustment lever 5 in a rotational movement direction D.

As represented by FIG. 4, FIG. 7 and FIG. 8, protruding sections 17 are provided on an adjustment lever 5 side in the stage 4. Further, the protruding sections 17 come into contact with stepped sections 13, which are provided in the main section 11 that is represented by FIG. 5A. Three stepped sections 13 are configured in a circumferential direction of the main section 11, that is, so that three stepped sections 13 each form 120° in a circumference of 360° of the main section 11. Further, the handle section 10 is configured so as to be capable of moving 120° in the rotational movement direction D to correspond to the stepped sections 13. Additionally, a rotational movement range of the handle section 10 is an upstream side in the setting direction A1. In addition, in the present embodiment, by having the stepped sections 13, it is possible to move the stage 4 in the direction C with respect to the connection mechanism 6 in multiple steps, but the configuration is not limited to this. A configuration that uses a gently inclined surface in place of the stepped sections 13, and can adjust the PG without steps, may also be used.

In addition, as represented by FIG. 4, FIG. 7 and FIG. 8, a guide shaft 18 and a guide shaft 19 are provided in the stage 4. Further, the guide shaft 18 passes through a hole section 12 that is provided in the main section 11 of the adjustment lever 5, and is plugged into a hole section (not shown in the drawings) that is provided in the connection mechanism 6. In addition, the guide shaft 19 is also plugged into a different hole section (not shown in the drawings) that is provided in the connection mechanism 6. In this manner, the stage 4 is fixed to the connection mechanism 6 in a state of being capable of moving in the direction C. That is, the guide shaft 18 and the guide shaft 19 have roles as connection sections that connect to the connection mechanism 6. Additionally, it is preferable that a contact section between the guide shaft 18 and the hole section 12, a contact section between the guide shaft 18 and a hole section of the connection mechanism 6 that corresponds to the guide shaft 18, and a contact section between the guide shaft 19 and a hole section of the connection mechanism 6 that corresponds to the guide shaft 19 have structures that are configured from a ball bush or the like, and are capable of sliding smoothly.

In this instance, in addition to a configuration that connects in a state of being directly fixed, "connect" also includes a configuration that props up in a moveable state, or a configuration that connects through a different member in the manner of the present embodiment.

In this manner, in the recording apparatus 1 of the present embodiment, by connecting the stage 4 with the connection mechanism 6 in a plurality of locations (the guide shaft 18 and the guide shaft 19), movement of the tray 2 with respect to the connection mechanism 6 in an intersecting direction that intersects the direction C, which is an adjustment direction of the PG is suppressed when the PG is adjusted. More specifically, for example, in a case of a configuration in which there is not guide shaft 19, and the stage 4 is connected to the connection mechanism 6 with the guide shaft 18 only, there is a concern that rotational movement of the stage 4 will be performed with the guide shaft 18 as an axis of rotation thereof. By configuring in this manner, and through the connection sections 18 and 19 having roles of movement suppression mechanisms in the intersecting direction, for example, a circumstance in which the tray 2 vibrates in the intersecting direction during recording is suppressed, and therefore, deteriorations in recording quality are suppressed.

In addition, as represented by FIG. 5A, the adjustment lever 7, which has the same configuration as the adjustment lever 5, has a main section 11, and a handle section 10, and a user can move the connection mechanism 6 in the direction C with respect to the base unit 8 (in directions that approach and separate from the base unit 8) by holding the handle section, and performing rotational movement of the adjustment lever 7 in a rotational movement direction D.

As represented by FIG. 4 and FIGS. 6 to 8, protruding sections 20 are provided on an adjustment lever 7 side in positions that oppose the adjustment lever 7 in the connection mechanism 6. Further, the protruding sections 20 come into contact with stepped sections 13, which are provided in the main section 11 that is represented by FIG. 5A. Three stepped sections 13 are configured in a circumferential direction of the main section 11, that is, so that three stepped sections 13 each form 120° in a circumference of 360° of the main section 11. Further, the handle section 10 is configured so as to be capable of moving 120° in the rotational movement direction D to correspond to the stepped sections 13. Additionally, a rotational movement range of the handle section 10 is an upstream side in the setting direction A1. In addition, in the present embodiment, by having the stepped sections 13, it is possible to move the connection mechanism 6 in the direction C with respect to base unit 8 in multiple steps, but the configuration is not limited to this. A configuration that uses a gently inclined surface in place of the stepped sections 13, and can adjust the PG without steps, may also be used.

In this instance, as represented by FIG. 4, and FIGS. 6 to 8, in the recording apparatus 1 of the present embodiment, the adjustment lever 5 and the adjustment lever 7 are provided in positions that do not overlap in the direction C, and therefore, positions that differ when viewed from the direction C. In other words, the first adjustment unit and the second adjustment unit are provided in positions that differ when viewed from the adjustment direction of the interval between the tray 2 and the recording unit. By configuring in this manner, and changing the positions in which the adjustment lever 5 and the adjustment lever 7, the adjustment ranges of which differ, are provided, false recognition of the adjustment units during adjustment of the PG by a user is suppressed.

Additionally, in the recording apparatus 1 of the present embodiment, in a case of using a target recording medium M such as a T-shirt, for example, which is set by being put on the tray 2 in the setting direction A1 from a hem T, as represented by FIG. 4, the adjustment lever 7 is disposed so as to be positioned on an outer side of the target recording medium M. In this manner, it is preferable that at least one of the adjustment units is disposed so as to be positioned on an outer side of the target recording medium M when the target recording medium M is set. This is because the operability by a user when adjusting the PG after the target recording medium M has been set becomes more favorable.

In addition, as represented by FIG. 4 and FIGS. 6 to 8, a guide shaft 21 and a guide shaft 22 are provided in the connection mechanism 6. Further, the guide shaft 21 passes through a hole section 12 that is provided in the main section 11 of the adjustment lever 7, and is plugged into a hole section (not shown in the drawings) that is provided in the base unit 8. In addition, the guide shaft 22 is also plugged into a different hole section (not shown in the drawings) that is provided in the base unit 8. In this manner, the connection mechanism 6 is fixed to the base unit 8 in a state of being capable of moving in the direction C. That is, the guide shaft 21 and the guide shaft 22 have roles as connection sections that connect to the base unit 8. Additionally, it is preferable that a contact section between the guide shaft 21 and the hole section 12, a contact section between the guide shaft 21 and a hole section of the base unit 8 that corresponds to the guide shaft 21, and a contact section between the guide shaft 22 and a hole section of the base unit 8 that corresponds to the guide shaft 22 have structures that are configured from a ball bush or the like, and are capable of sliding smoothly.

In this manner, in the recording apparatus 1 of the present embodiment, by connecting the connection mechanism 6 with the base unit 8 in a plurality of locations (the guide shaft 21 and the guide shaft 22), movement of the tray 2 with respect to the base unit 8 in an intersecting direction that intersects the direction C, which is an adjustment direction of the PG is suppressed when the PG is adjusted. More specifically, for example, in a case of a configuration in which there is not guide shaft 22, and the connection mechanism 6 is connected to the base unit 8 with the guide shaft 21 only, there is a concern that rotational movement of the connection mechanism 6 will be performed with the guide shaft 21 as an axis of rotation thereof. By configuring in this manner, and through the connection sections 21 and 22 having roles of movement suppression mechanisms in the intersecting direction, for example, a circumstance in which the tray 2 vibrates in the intersecting direction during recording is suppressed, and therefore, deteriorations in recording quality are suppressed. In summary, the recording apparatus 1 is provided with a first connection section, which connects the base unit 8 and the tray 2, and in which at least one of the first adjustment unit and the second adjustment unit are provided, and a second connection section that connects the base unit 8 and the tray 2. In addition, the recording apparatus 1 may be provided with three or more connection sections.

In addition, as represented by FIG. 5B, the stepped sections 13 of the present embodiment are provided with flat sections 14, inclined surface sections 15, and convex sections 16 that are positioned between the flat sections 14 and the inclined surface sections 15. Therefore, when the protruding sections 17 and the protruding sections 20 are moved in a direction E1 by performing rotational movement of the adjustment lever 5 and the adjustment lever 7 in a rotational movement direction D1, and when the protruding sections 17 and the protruding sections 20 are moved in a direction E2 by performing rotational movement of the adjustment lever 5 and the adjustment lever 7 in a rotational movement direction D2, the protruding sections 17 and the protruding sections 20 can easily stop at a position of the flat sections 14, and it is possible to retain the protruding sections 17 and the protruding sections 20 in stably stopped states.

Additionally, the larger an inclination angle θ of the stepped sections 13 becomes, the wider the adjustment range of the PG becomes, and the recording apparatus 1 of the present embodiment is configured so that an inclination angle θ2 of the stepped sections 13 in the adjustment lever 7 is greater than an inclination angle θ1 of the stepped sections 13 in the adjustment lever 5. That is, the adjustment range of the PG of the adjustment lever 7 is wider than that of the adjustment lever 5, the adjustment lever 7 configures an adjustment unit for coarse adjustments, and the adjustment lever 5 configures an adjustment unit for minute adjustments. In addition, in a case in which the adjustment lever 5 and the adjustment lever 7 have configurations that can adjust the PG in multiple steps, an adjustment amount per step (an amount of movement of the stage 4 in the direction C) of the adjustment lever 7 is greater than that of the adjustment lever 5. As a result of this, even if an amount of rotation of the adjustment levers is the same, it is possible to perform minute adjustments in the adjustment lever 5, and coarse adjustments in the adjustment lever 7.

Embodiment 2

FIG. 9

Next, a recording apparatus 1 of embodiment 2 will be described with reference to the appended drawings.

Figure 9:
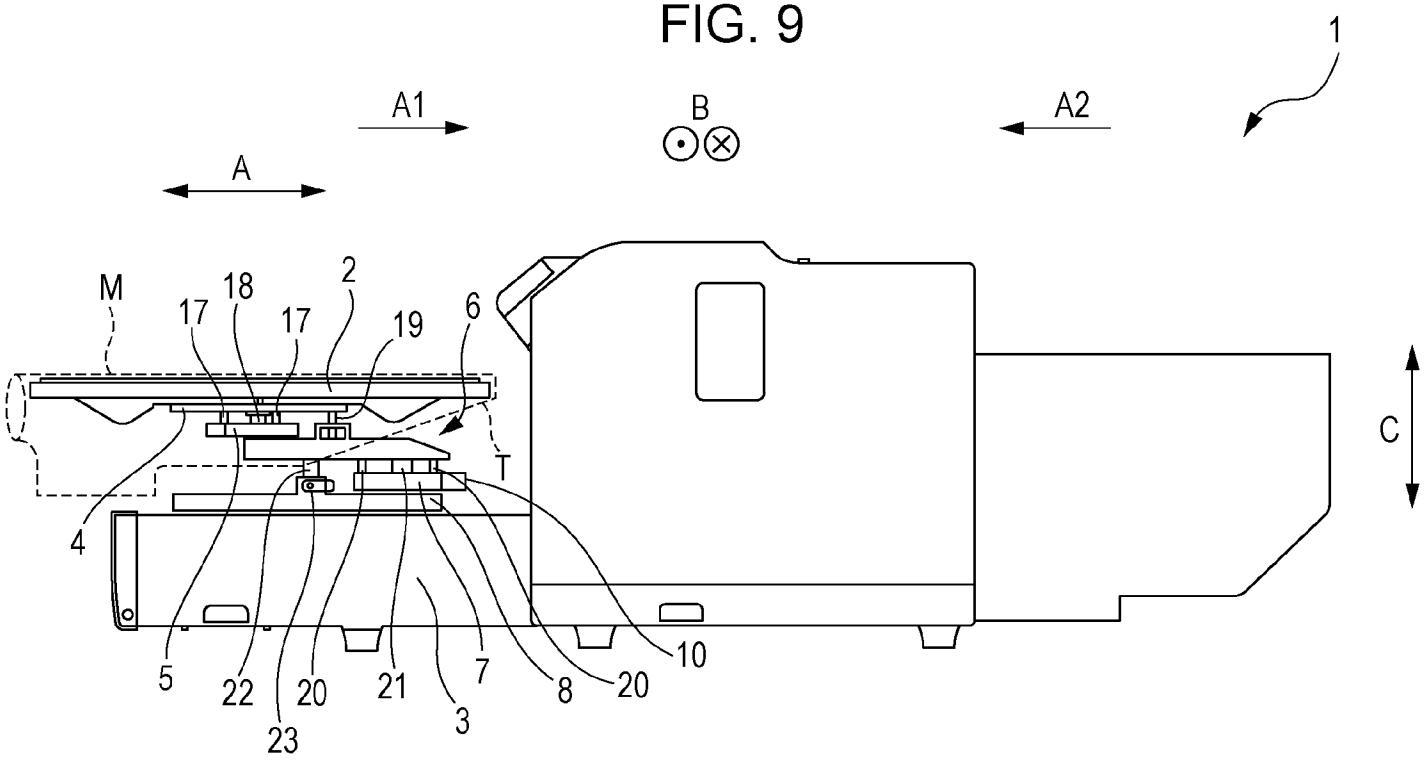
FIG. 9 is a schematic perspective view that represents the main parts of a recording apparatus according to embodiment 2 of the invention.

FIG. 9 is a schematic perspective view that represents a recording apparatus 1 of embodiment 2, and is a view that corresponds to FIG. 4 in the recording apparatus 1 of embodiment 1. Additionally, constituent members that are shared with the abovementioned embodiment will be shown with the same symbols, and detailed description thereof will be omitted.

Additionally, other than the disposition of the main parts of the adjustment lever 7, the guide shaft 21, the guide shaft 22 and the like, the recording apparatus 1 of the present embodiment has the same configuration as the recording apparatus 1 of embodiment 1.

The adjustment lever 7 of the present embodiment is an adjustment lever that has a moveable range of the handle section 10 on the downstream side in the setting direction A1. In other words, the handle section 10 of the adjustment lever 7 is positioned further on a downstream side in the setting direction A1 than the guide shaft 21 that is provided with the adjustment lever 7. In summary, at least one of the first adjustment unit and the second adjustment unit is a lever that has a moveable range on a downstream side in the setting direction A1. Therefore, a user can even adjust the PG from a side that is opposite to the setting direction A1 after the target recording medium M has been set on the tray 2, and therefore, the operability of the recording apparatus 1 of the present embodiment becomes more favorable when adjusting the PG. This is because an opening is opened at a downstream side end section in the setting direction A1 of the target recording medium M (a hem T), and the handle section 10 of the adjustment lever 7 is not completely covered.

In addition, the guide shaft 22 that also serves a role of a movement suppression mechanism is provided in a position that is closer to the center of gravity of the tray 2 than the guide shaft 21 in which the adjustment lever 7 is provided. In other words, the second connection section is provided in a position that is closer to the center of gravity of the tray 2 than the first connection section in which the adjustment unit is provided.

In this instance, in the recording apparatus 1 of the present embodiment, the guide shaft 21 that the adjustment lever 7 is provided with is provided in a position that is separated from a center of gravity position of the tray 2. However, as a result of the guide shaft 22 being provided in a position that is close to the center of gravity of the tray 2, a circumstance in which the connection mechanism 6, to which the tray 2 is connected, drops (becomes unstable) with respect to the base unit 8 is suppressed. Further, in addition to this, by providing the guide shaft 21, in which the adjustment lever 7 is provided, in a position that is separated from the center of gravity position of the tray 2, it is possible to adjust the PG at a position that is far from the vicinity of a center of gravity of the tray 2 in which there is a tendency for constituent members of the recording apparatus 1 to be closely packed, and therefore, the operability for a user becomes more favorable when adjusting the PG. That is, the recording apparatus 1 of the present embodiment achieves both stabilization of the tray 2 with respect to the base unit 8, and operability for a user when adjusting the PG at high levels.

In addition, the recording apparatus 1 of the present embodiment is provided with a fixing lever 23 as a fixed section for fixing a position of the connection mechanism 6 with respect to the base unit 8, which has been adjusted by the adjustment lever 7. Therefore, a position retention performance (that is, a PG retention performance) becomes favorable. Additionally, a configuration in which a fixing section for fixing a position of the stage 4 with respect to the connection mechanism 6, which has been adjusted by the adjustment lever 5 is provided either in place of the fixing lever 23, or in addition to the fixing lever 23, may also be used.

Embodiment 3

FIG. 10

Next, a recording apparatus 1 of embodiment 3 will be described with reference to the appended drawings in detail.

Figure 10:
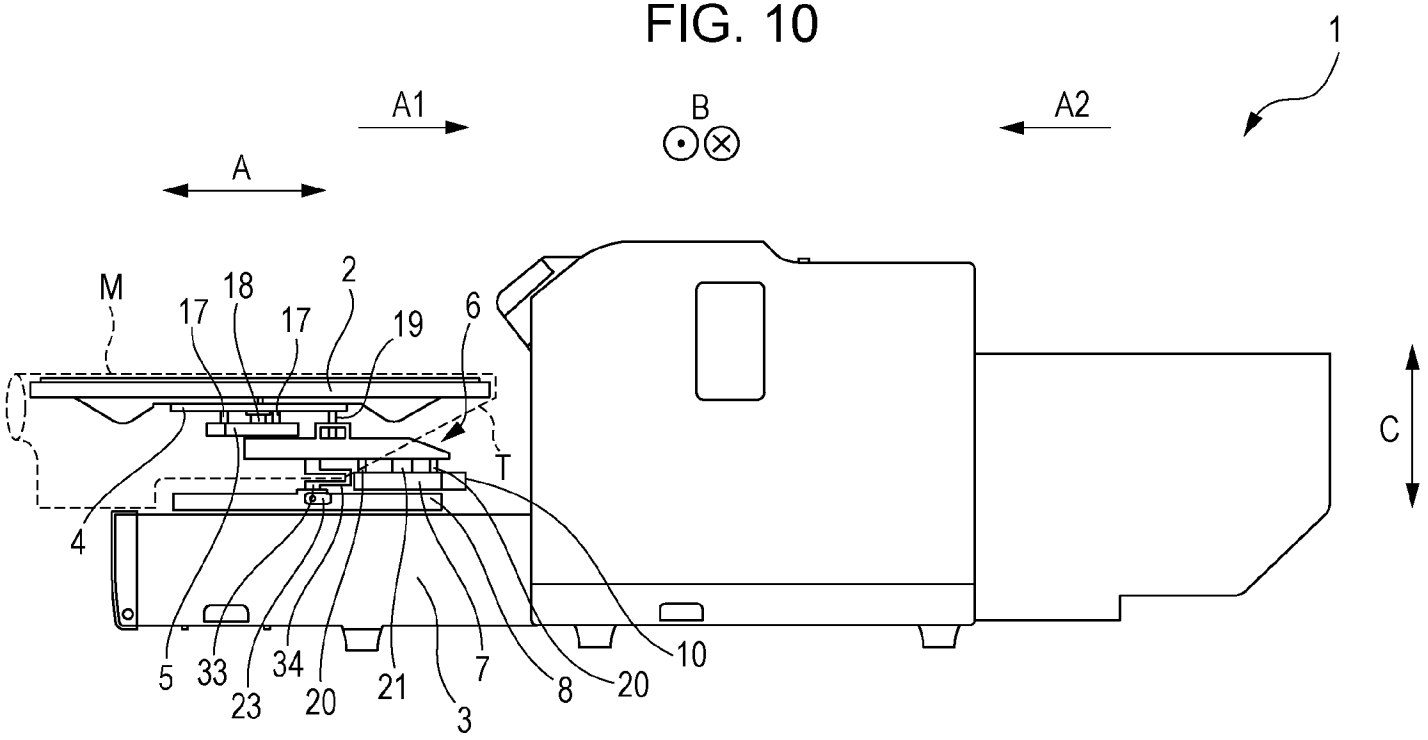
FIG. 10 is a schematic perspective view that represents the main parts of a recording apparatus according to embodiment 3 of the invention.

FIG. 10 is a schematic lateral view that represents a recording apparatus 1 of embodiment 3, and is a view that corresponds to FIG. 4 in the recording apparatus 1 of embodiment 1, and FIG. 9 in the recording apparatus 1 of embodiment 2. Additionally, constituent members that are shared with the abovementioned embodiments will be shown with the same symbols, and detailed description thereof will be omitted.

Additionally, other than being provided with a guide shaft 33, which has a U-shaped section 34, in place of the cylindrical guide shaft 22, the recording apparatus 1 of the present embodiment has the same configuration as the recording apparatus 1 of embodiment 2.

The recording apparatus 1 of the present embodiment is provided with a guide shaft 33 as a connection section, which has a U-shaped section 34, further on the upstream side in the setting direction A1 than the guide shaft 21 in which the adjustment lever 7 is provided. As represented by FIG. 10, the U-shaped section 34 is a concave section that is indented on the downstream side in the setting direction A1, and for example, it is possible to position the hem T of a T-shirt, as the target recording medium M, on the downstream side in the setting direction A1. In other words, the second connection section is provided further on the upstream side in the setting direction A1 than the first connection section, in which the adjustment units are provided, and has a concave section that is indented on the downstream side in the setting direction A1. That is, as is evident from a comparison of FIG. 9 and FIG. 10, in the recording apparatus 1 of the present embodiment, it is possible to position the target recording medium M, which is set by being put on the tray 2 in the setting direction A1 from the hem T, further along in the setting direction A1. Therefore, in the recording apparatus 1 of the present embodiment, in a case of using a target recording medium M such as a T-shirt, for example, which is set by being put on the tray 2 in the setting direction A1 from a hem T, a configuration in which it is possible to support the target recording medium M stably on the tray 2, is attained.

Embodiment 4

FIG. 11 to FIG. 14

Next, a recording apparatus 1 of embodiment 4 will be described with reference to the appended drawings in detail.

Figure 11:
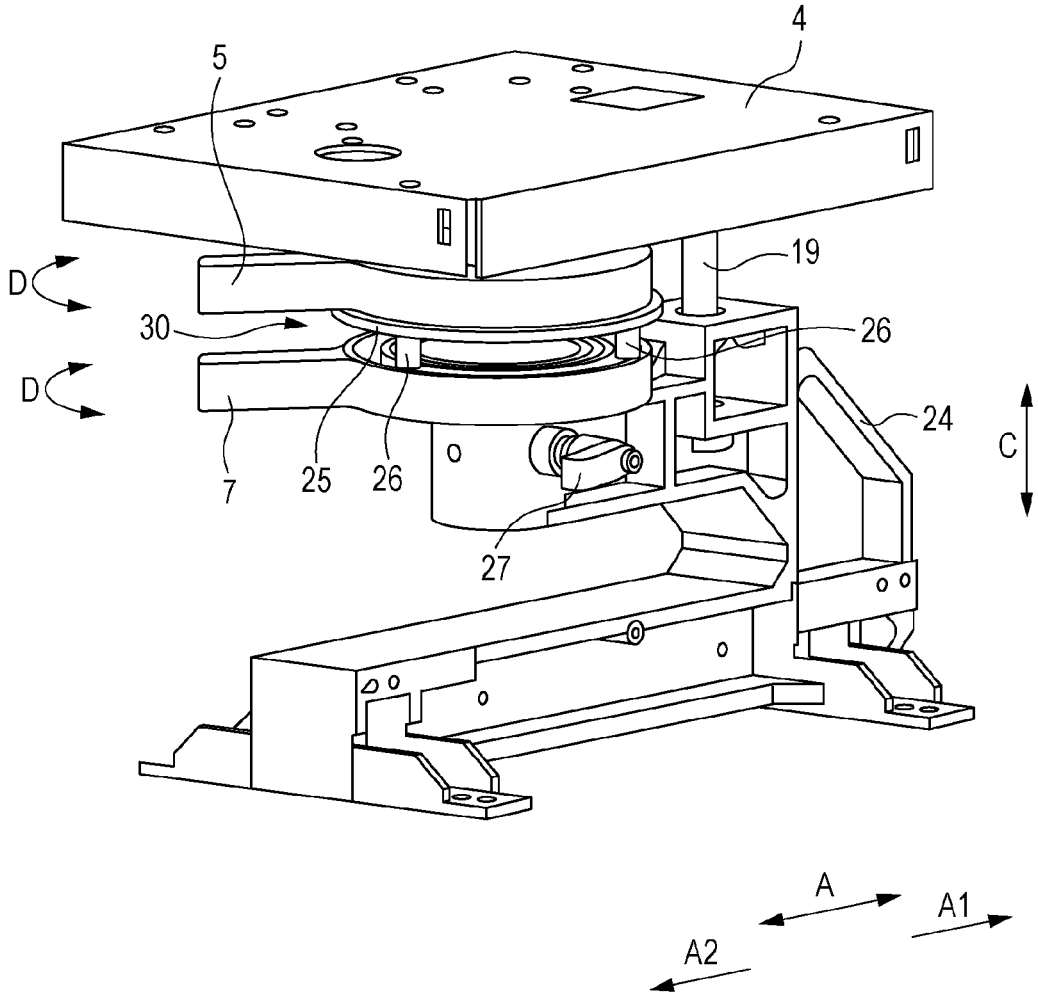
FIG. 11 is a schematic lateral view that represents the main parts of a recording apparatus according to embodiment 4 of the invention.
Figure 12:
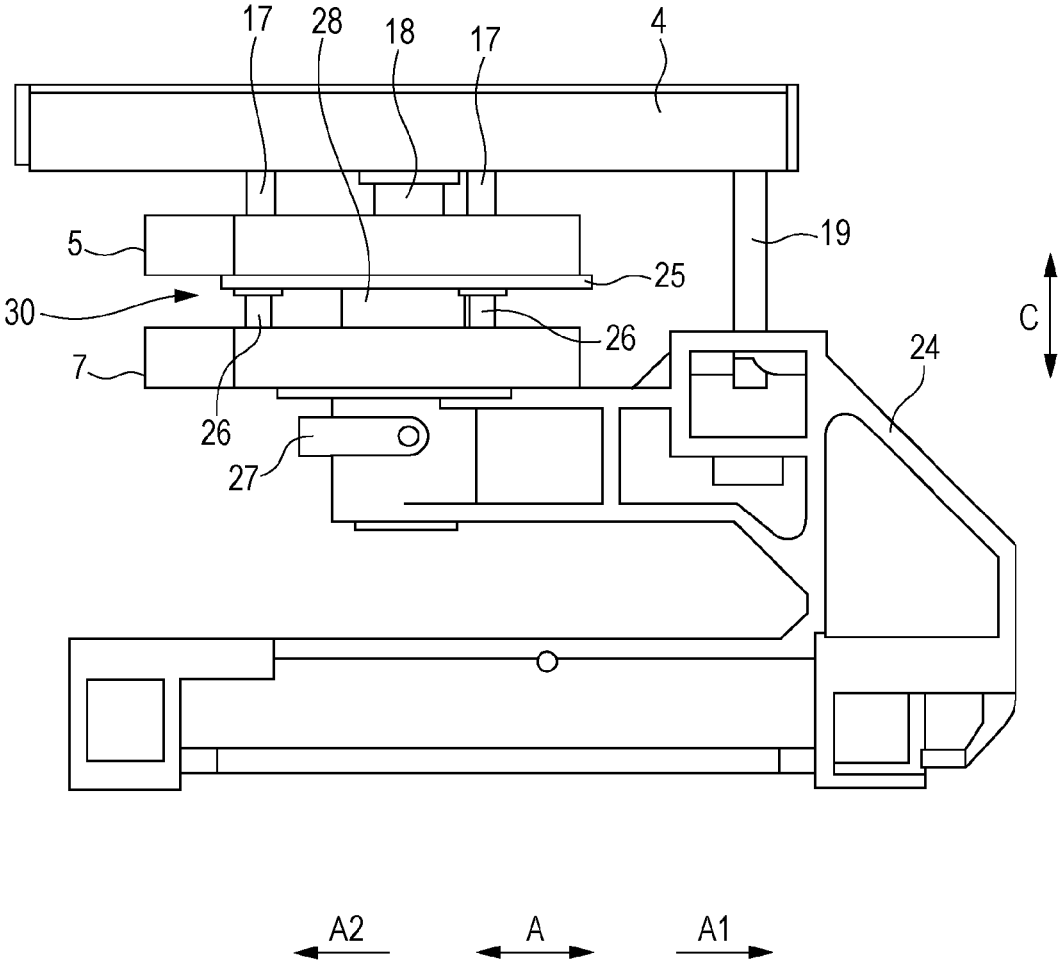
FIG. 12 is a schematic lateral view that represents the main parts of the recording apparatus according to embodiment 4 of the invention.
Figure 13:
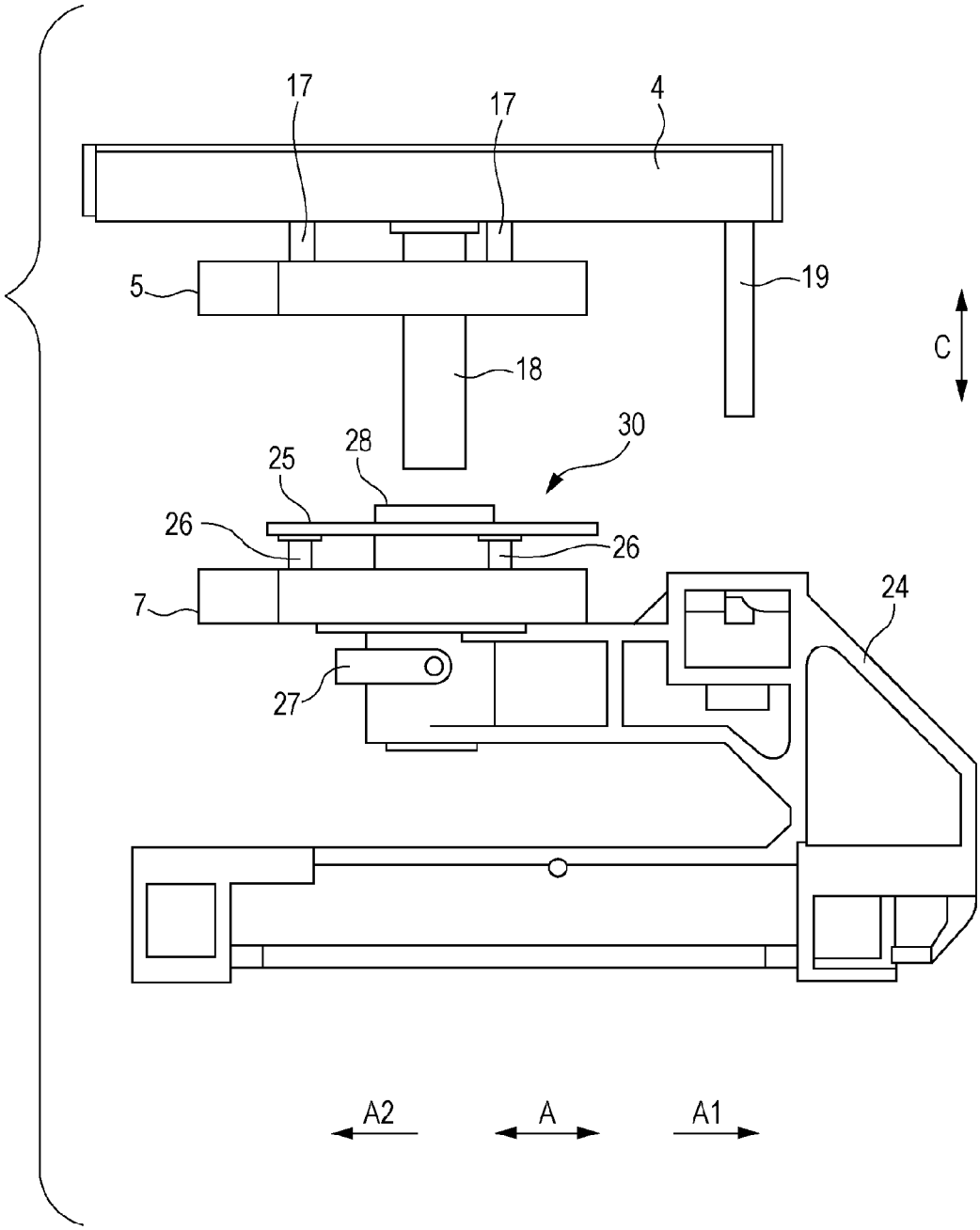
FIG. 13 is a schematic exploded lateral view that represents the main parts of the recording apparatus according to embodiment 4 of the invention.

FIG. 11 is a schematic perspective view that represents a recording apparatus 1 of embodiment 4, and is a view that corresponds to FIG. 6 in the recording apparatus 1 of embodiment 1. In addition, FIG. 12 is a schematic lateral view that represents the recording apparatus 1 of embodiment 4, and is a view that corresponds to FIG. 7 in the recording apparatus 1 of embodiment 1. In addition, FIG. 13 is a schematic exploded lateral view that represents the recording apparatus 1 of embodiment 4, and is a view that corresponds to FIG. 8 in the recording apparatus 1 of embodiment 1. Additionally, constituent members that are shared with the abovementioned embodiments will be shown with the same symbols, and detailed description thereof will be omitted.

As represented by FIGS. 11 to 13, the recording apparatus 1 of the present embodiment has a configuration in which a base unit 24 is set to a U-shape, and the adjustment lever 5 and the adjustment lever 7 are not easy to be provided in different positions. Therefore, the adjustment lever 5 and the adjustment lever 7 are disposed in positions that overlap in the direction C, which is the adjustment direction of the PG. In other words, the first adjustment unit and the second adjustment unit are provided in positions that overlap in the adjustment direction of the interval between the tray 2 and the recording unit. In this manner, by positioning the adjustment lever 5 and the adjustment lever 7 in positions that overlap in the direction C, a configuration in which a plurality of adjustment units is provided is set, and therefore, both a reduction in the size of an adjustment unit, and adjustment of the PG with high precision is achieved.

In addition, as represented by FIGS. 11 to 13, in the recording apparatus 1 of the present embodiment, a prop pillar 28, in which a hole section 35 (refer to FIG. 14) through which the guide shaft 18 that is provided in the stage 4, is passed, is provided, is provided in a portion in which the rotational centers of the adjustment lever 5 and the adjustment lever 7 are positioned. Further, the adjustment lever 5 is propped up by the prop pillar 28 from a lower side (an adjustment lever 7 side), and the adjustment lever 7 is propped up by the base unit 24 from a lower side in a state in which the prop pillar 28 is passed through the hole section 12 (refer to FIG. 5). As a result of this kind of configuration, in the recording apparatus 1 of the present embodiment, the adjustment lever 5 and the adjustment lever 7 both have the guide shaft 18 as a rotational axis thereof.

In this manner, since the adjustment lever 5 and the adjustment lever 7 share a rotational axis, in a case in which an attempt is made to adjust the PG by performing rotational movement of either the adjustment lever 5 or the adjustment lever 7 only in the rotational movement direction D, it is possible for a non-target adjustment lever of the adjustment lever 5 or the adjustment lever 7 to corotate as a result of a rotational movement action of a target adjustment lever. In particular, it is possible to that the upper side adjustment lever 5 will corotate unnecessarily as a result of rotational movement of the lower side adjustment lever 7. In this instance, "corotation" refers to a circumstance in which a different object to which force has not been applied is rotating at the same time when force is applied to a certain object. Therefore, in the recording apparatus 1 of the present embodiment, a corotation suppression mechanism 30 for suppressing a circumstance in which this kind of corotation occurs, and operability by a user deteriorates during the adjustment of the PG.

Next, the corotation suppression mechanism 30 of the present embodiment will be described in detail.

Figure 14:
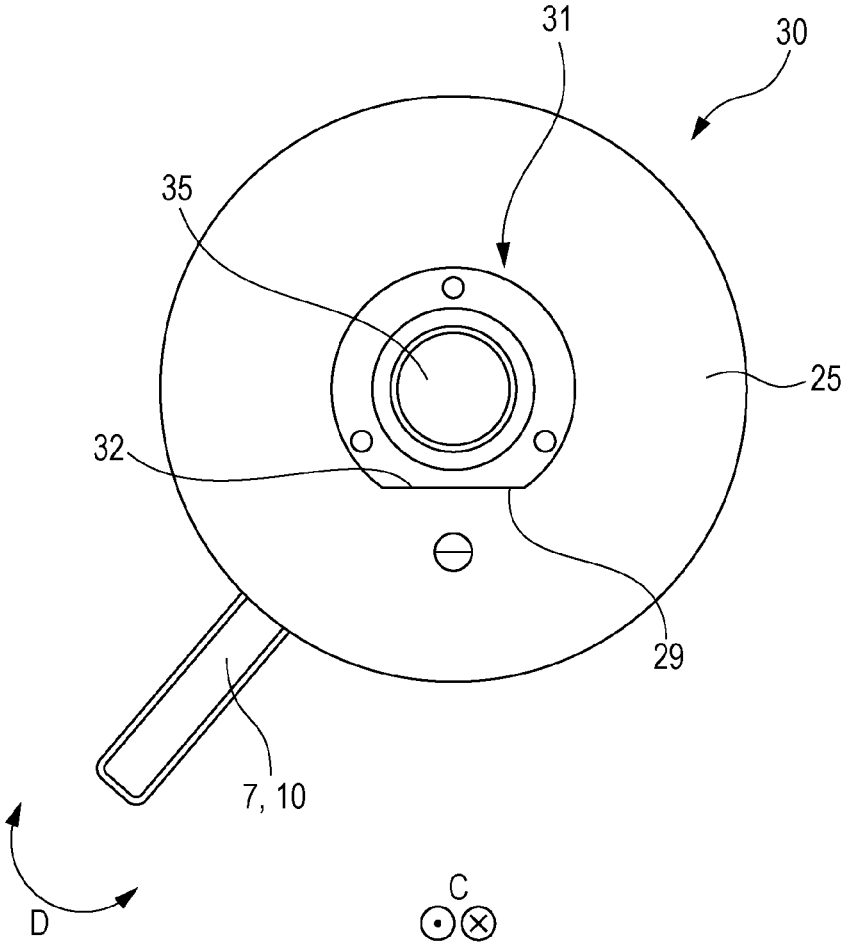
FIG. 14 is a schematic plan view that represents the main parts of the recording apparatus according to embodiment 4 of the invention.

FIG. 14 is a schematic plan view that represents the corotation suppression mechanism 30, which is a main part of the recording apparatus 1 of the present embodiment.

As represented by FIG. 14, the corotation suppression mechanism 30 of the present embodiment is configured by an disc-shaped intermediate member 25 that is provided between the adjustment lever 5 and the adjustment lever 7, and a hole section 31 which passes through the prop pillar 28 is provided. Further, as represented by FIGS. 11 to 13, the intermediate member 25 suppresses a circumstance in which the adjustment lever 5 and the adjustment lever 7 come into contact.

In addition, a flat surface section 29 is provided in the prop pillar 28, and a flat surface section 32 is also provided in the hole section 31 so as to correspond to the flat surface section 29. Therefore, as a result of being provided with the flat surface section 32, which is a rotational movement suppression structure, even if rotational movement of the adjustment lever 5 and the adjustment lever 7 is performed in the rotational movement direction D, the intermediate member 25 suppresses a circumstance in which a non-target adjustment lever of the adjustment lever 5 or the adjustment lever 7 corotates as a result of a rotational movement action of a target adjustment lever without performing rotational movement in the rotational movement direction D with respect to the prop pillar 28.

Additionally, as represented by FIGS. 11 to 13, the intermediate member 25 is provided with protruding sections 26 that come into contact with the stepped sections 13 of the adjustment lever 7 (refer to FIG. 5) on a lower side (an adjustment lever 7 side) thereof, and is a disc-shaped member, in which the hole section 31, which has a flat surface section 32, is provided. That is, the recording apparatus 1 of the present embodiment suppresses a circumstance in which a non-target adjustment lever of the adjustment lever 5 or the adjustment lever 7 corotates as a result of a rotational movement action of a target adjustment lever using the corotation suppression mechanism 30 which has this kind of simple configuration.

Additionally, in the recording apparatus 1 of the present embodiment, the corotation suppression mechanism is configured by a disc-shaped intermediate member 25 that is provided between the adjustment lever 5 and the adjustment lever 7, but is not limited to this kind of configuration.

For example, in addition to a configuration in which the intermediate member is not configured, and the protruding sections 26, which come into contact with the stepped sections 13 in the adjustment lever 7 are provided on a lower side (an adjustment lever 7 side) of the adjustment lever 5 of a higher side, a configuration that suppresses corotation by changing a friction force when performing rotational movement using both the adjustment lever 5 and the adjustment lever 7 as a result of adjusting the inclination angles θ (refer to FIGS. 5A and 5B) and shapes of the adjustment lever 5 and the adjustment lever 7, and setting so that a non-target adjustment lever does not perform rotational movement even if a target adjustment lever performs rotational movement, may also be used. In addition, for example, a fixing unit such as a fixing lever may be provided to correspond to each of the adjustment lever 5 and the adjustment lever 7.

Furthermore, a configuration in which corotation is suppressed by a user holding and restraining the handle section of a non-target adjustment lever of the adjustment lever 5 and the adjustment lever 7 when rotational movement of a target adjustment lever is performed, or the like, and a configuration that does not include a corotation suppression mechanism may also be used. In summary, the corotation suppression mechanism 30 is a mechanism that suppresses rotational movement of a non-target adjustment lever that follows the rotational movement of a target adjustment lever. Further, the corotation suppression mechanism 30 is provided between a target adjustment lever and a non-target adjustment lever, and includes a suppression structure of rotational movement that follows a target adjustment lever and a non-target adjustment lever.

In addition, as represented by FIGS. 11 to 13, the recording apparatus 1 of the present embodiment is provided with a fixing lever 27 as a fixing unit for fixing a position of the stage 4 with respect to the base unit 24 that has been adjusted by the adjustment lever 5 and the adjustment lever 7. Therefore, the retention performance of the position (that is, the retention performance of the PG) becomes favorable.

Additionally, the invention is not limited to the above-mentioned embodiments, various modifications are possible within the range of the invention that is disclosed in the aspects, and naturally, such modifications are also included within the scope of the invention. The recording apparatus 1 of the present embodiment is, more specifically put, an ink jet type fabric printer which performs printing on a fiber shaped printing target. However, as longs as the recording apparatus 1 is an apparatus that performs printing (recording) on a target medium, the recording apparatus 1 may be any kind of apparatus.

The invention has been described in detail above on the basis of specific embodiments. In this instance, the invention will be described once more in summary.

The recording apparatus 1 of the first aspect of the invention is provided with support unit 2 that is capable of supporting a target recording medium M, a recording unit 9 that is capable of recording on a target recording medium M that is supported by the support unit 2, a first adjustment unit 5 (7) that adjusts an interval between the support unit 2 and the recording unit 9, and a second adjustment unit 7 (5) that adjusts an interval between the support unit 2 and the recording unit 9.

According to the aspect, a plurality of adjustment units 5 and 7, which adjust the interval (the so-called PG) between the support unit 2 and the recording unit 9, are provided. Therefore, since it is possible to configure by dividing an adjustment unit into the adjustment units 5 and 7, it is possible to suppress an increase in the sizes of the adjustment units 5 and 7 that is due to an increase in an adjustment range thereof. In addition, since minute adjustments of the PG are also possible as a result of changing the adjustment range of each adjustment unit 5 and 7, or the like, it is possible to adjust the PG with high precision. That is, it is possible to achieve both a reduction in the size of the adjustment units 5 and 7, and adjustment with high precision.

In the recording apparatus 1 of the second aspect of the invention, according to the first aspect, an adjustment range of the first adjustment unit 5 (7) and an adjustment range of the second adjustment unit 7 (5) differ.

According to the aspect, the plurality of adjustment units 5 and 7 respectively have different adjustment ranges. Therefore, minute adjustments of the PG are made possible, and it is possible to adjust the PG with high precision.

In the recording apparatus 1 of the third aspect of the invention, according to the first aspect or the second aspect, the first adjustment unit 5 (7) and the second adjustment unit 7 (5) are provided in different positions when viewed from an adjustment direction C of the interval.

According to the aspect, the plurality of adjustment units 5 and 7 are provided in positions that differ when viewed from the adjustment direction C of the PG. Therefore, for example, in a case in which the adjustment units 5 and 7, which have different adjustment ranges, are provided, by changing the positions in which the adjustment units are provided, it is possible to suppress false recognition of the adjustment units 5 and 7 during adjustment of the PG by a user.

In the recording apparatus 1 of the fourth aspect of the invention, according to any one of the first aspect to the third aspect, in the support unit 2, it is possible to set the target recording medium M from the setting direction A1 that intersects the adjustment direction C of the interval, and at least one of the first adjustment unit 5 (7) and the second adjustment unit 7 (5) is an adjustment lever 7 that has a moveable range on a downstream side in the setting direction A1.

In this instance, "it is possible to set the target recording medium M from the setting direction A1 that intersects the adjustment direction C of the interval", for example, refers to the fact that it is possible to set a target recording medium M, which has an insertion section, such as the hem T of a T-shirt and a hand insertion section of gloves, from at least one direction, and includes any configuration in which it is possible to mount and set the target recording medium M as long as it is possible to set the target recording medium M in this manner.

According to the aspect, at least one of the plurality of adjustment units 5 and 7 is an adjustment lever 7 that has a moveable adjustment range on a downstream side in the setting direction A1. Therefore, it is even possible for a user to adjust the PG from the direction A2 that is opposite to the setting direction A1 after the target recording medium M has been set on the support unit 2.

In the recording apparatus 1 of the fifth aspect of the invention, according to any one of the first aspect to the fourth aspect, a base unit 8, a first connection section 21, which connects the base unit 8 and the support unit 2, and which is provided with at least one of the first adjustment unit 5 (7) and the second adjustment unit 7 (5), and a second connection section 22 that connects the base unit 8 and the support unit 2, are further provided.

In this instance, in addition to a configuration that connects in a state of being directly fixed, "connect" also includes a configuration that props up in a moveable state, or a configuration that connects through a different member.

According to the aspect, there is a plurality of connection sections 21 and 22. Therefore, the connection sections 21 and 22 have roles of movement suppression mechanisms that suppress movement of the support unit 2 with respect to the base unit 8 in the intersecting direction that intersects the adjustment direction C of the interval when adjustment of the interval is performed. Accordingly, movement of the support unit 2 with respect to the base unit 8 in the intersecting direction is suppressed, and for example, a circumstance in which the support unit 2 vibrates in the intersecting direction during recording is suppressed, and therefore, deteriorations in recording quality are suppressed.

In the recording apparatus 1 of the sixth aspect of the invention, according to the fifth aspect, the second connection section 22 is provided in a position that is closer to the center of gravity of the support unit 2 than the first connection section 21.

According to the aspect, at least one (the connection section 22) of the plurality of connection sections is provided in a position that is closer to the center of gravity of the support unit 2 than the connection section 21, in which the adjustment unit 7 is provided. Therefore, using the connection section 22, it is even possible to suppress a circumstance in which the tray 2 drops (becomes unstable) with respect to the base unit 8 in a case in which the connection section 21, in which the adjustment unit 7 is provided, is provided in a position that is separated from a center of gravity position of the support unit 2. In addition, it is possible to adjust the PG at a position that is far from the vicinity of a center of gravity of the tray 2. Accordingly, in addition to it being possible to stabilize the support unit 2 with respect to the base unit 8, it is possible to improve the operability for a user when adjusting the PG.

In the recording apparatus 1 of the seventh aspect of the invention, according to the sixth aspect, in the support unit 2, it is possible to set the target recording medium M from a setting direction A1 that intersects an adjustment direction C of the interval, and the second connection section 33 is provided further on an upstream side in the setting direction A1 than the first connection section 21, and has a concave section 34 that is indented on a downstream side in the setting direction A1.

According to the aspect, the connection section 33 has a concave section 34 that is indented on a downstream side in the setting direction A1. Therefore, in a case of using a target recording medium M such as a T-shirt, for example, which is set on the support unit 2 from the setting direction A1, it is possible to position the target recording medium M further along in the setting direction A1, and therefore, it is possible to stably support the target recording medium M on the support unit 2.

In the recording apparatus 1 of the eighth aspect of the invention, according to the first aspect or the second aspect, the first adjustment unit 5 (7) and the second adjustment unit 7 (5) are provided in positions that overlap in the adjustment direction C of the interval.

According to the aspect, the plurality of adjustment units 5 and 7 are provided in positions that overlap in the adjustment direction C. Therefore, it is even possible to achieve both a reduction in the size of the adjustment units 5 and 7, and adjustment with high precision in a case in which the plurality of adjustment units 5 and 7 are not easy to be provided in different positions.

In the recording apparatus 1 of the ninth aspect of the invention, according to the eighth aspect, the first adjustment unit 5 (7) and the second adjustment unit 7 (5) are adjustment levers that have rotational axes in the adjustment direction C of the interval, and a corotation suppression mechanism 30 that suppresses the rotational movement of a non-target adjustment lever 7 (5) that follows the rotational movement of a target adjustment lever 5 (7), is provided.

According to the aspect, a corotation suppression mechanism 30 that suppresses the rotational movement of a non-target adjustment lever 7 (5) that follows the rotational movement of a target adjustment lever 5 (7), is provided. Therefore, it is possible to suppress a circumstance in which operability for a user deteriorates when adjusting the PG as a result of a non-target adjustment lever 7 (5) corotating when performing the adjustment of the PG with a target adjustment lever 5 (7).

In the recording apparatus 1 of the tenth aspect of the invention, according to the ninth aspect, the corotation suppression mechanism 30 is provided between a target adjustment lever 5 (7) and a non-target adjustment lever 7 (5), and has a structure 32 that suppresses rotational movement that follows the rotational movements of a target adjustment lever 5 (7) and a non-target adjustment lever 7 (5).

According to the aspect, the corotation suppression mechanism 30 is provided between a target adjustment lever 5 (7) and a non-target adjustment lever 7 (5), and includes a structure 32 that suppresses rotational movement that follows the rotational movements of a target adjustment lever 5 (7) and a non-target adjustment lever 7 (5). Therefore, it is possible to configure the corotation suppression mechanism 30 easily.

The entire disclosure of Japanese Patent Application No. 2014-125088, filed Jun. 18, 2014 is expressly incorporated reference herein.

What is claimed is:

1. A recording apparatus comprising:

a support unit that is capable of supporting a target recording medium;

a recording unit that is capable of recording on a target recording medium that is supported by the support unit;

a first adjustment unit that changes a position of the support unit to adjust an interval between the support unit and the recording unit; and a second adjustment unit that changes a position of the support unit to adjust an interval between the support unit and the recording unit, wherein the first adjustment unit and the second adjustment unit are provided in positions that overlap in an adjustment direction of the interval wherein the first adjustment unit and the second adjustment unit are adjustment levers that have rotational axes in the adjustment direction of the interval, and wherein a corotation suppression mechanism that suppresses the rotational movement of a non-target adjustment lever that follows the rotational movement of a target adjustment lever, is provided.

2. The recording apparatus according to claim 1, wherein an adjustment range of the first adjustment unit and an adjustment range of the second adjustment unit differ.

3. The recording apparatus according to claim 1, wherein the first adjustment unit and the second adjustment unit are provided in different positions when viewed from an adjustment direction of the interval.

4. The recording apparatus according to claim 1, wherein in the support unit, it is possible to set the target recording medium from a setting direction that intersects an adjustment direction of the interval, and wherein at least one of the first adjustment unit and the second adjustment unit includes a guide shaft and an adjustment lever that has a moveable range on a downstream side of the guide shaft in the setting direction.

5. The recording apparatus according to claim 1, further comprising:

a base unit;

a first connection section, which connects the base unit and the support unit, and which is provided with at least one of the first adjustment unit and the second adjustment unit; and a second connection section that connects the base unit and the support unit.

6. The recording apparatus according to claim 5, wherein the second connection section is provided in a position that is closer to the center of gravity of the support unit than the first connection section.

7. The recording apparatus according to claim 6, wherein in the support unit, it is possible to set the target recording medium from a setting direction that intersects an adjustment direction of the interval, and wherein the second connection section is provided further on an upstream side in the setting direction than the first connection section, and has a concave section that is indented on a downstream side of the second connection section in the setting direction.

8. The recording apparatus according to claim 1, wherein the corotation suppression mechanism is provided between the target adjustment lever and the non-target adjustment lever, and has a structure that suppresses the rotational movement that follows the rotational movements of a target adjustment lever and a non-target adjustment lever.

* * * * *